US008244144B2

(12) United States Patent
Tsuzuki

(10) Patent No.: US 8,244,144 B2
(45) Date of Patent: Aug. 14, 2012

(54) PRINTING DEVICE AND PRINTING SYSTEM TO MANAGE PRINT JOBS BASED ON PRINT HISTORY AND COMPUTER READABLE STORAGE MEDIUM FOR STORING A COMPUTER PROGRAM THEREFOR

(75) Inventor: Ryosuke Tsuzuki, Aichi (JP)

(73) Assignee: Brother Kogyo Kabushiki Kaisha, Aichi (JP)

( * ) Notice: Subject to any disclaimer, the term of this patent is extended or adjusted under 35 U.S.C. 154(b) by 395 days.

(21) Appl. No.: 12/565,250

(22) Filed: Sep. 23, 2009

(65) Prior Publication Data

US 2010/0080572 A1 Apr. 1, 2010

(30) Foreign Application Priority Data

Sep. 26, 2008 (JP) ..... 2008-248600

(51) Int. Cl.
*G03G 15/00* (2006.01)

(52) U.S. Cl. ..... 399/10; 399/18; 399/80

(58) Field of Classification Search ..... 399/10, 399/18, 19, 79, 80
See application file for complete search history.

(56) References Cited

U.S. PATENT DOCUMENTS

2006/0077433 A1* 4/2006 Zhang et al. ..... 358/1.15

FOREIGN PATENT DOCUMENTS

| | | |
|---|---|---|
| JP | 2003-67174 | 3/2003 |
| JP | 2005-107574 | 4/2005 |
| JP | 2005-141361 | 6/2005 |
| JP | 2005141361 A * | 6/2005 |
| JP | 2007-264916 | 10/2007 |
| JP | 2007-323463 | 12/2007 |
| JP | 2008-118418 | 5/2008 |
| JP | 2008-152402 | 7/2008 |

OTHER PUBLICATIONS

Japanese Official Action dated May 17, 2011 together with an English language translation from JP 2008-248600.

Japanese Official Action dated May 11, 2010, together with English-language translation.

Japanese Official Action dated Feb. 15, 2011 together with an English language translation from JP 2008-248600.

Japanese Official Action dated Sep. 21, 2010, together with English-language translation.

* cited by examiner

*Primary Examiner* — David Gray
*Assistant Examiner* — Joseph S Wong
(74) *Attorney, Agent, or Firm* — Scully, Scott, Murphy & Presser, P.C.

(57) ABSTRACT

A printing apparatus connectable with an external storage device is provided. The printing apparatus includes a printer unit to execute a printing operation to print an image in a current print job, a print log provider to provide a print log, which indicates a record of the printing operation for the current print job, to the external storage device, a print log obtainer to obtain a preceding print log, indicating a record of an earlier printing operation executed earlier in the printing apparatus, provided to and stored in the external storage device, a print log examiner to examine the preceding print log and determine normality of the preceding print log based on the record of the earlier print operation, and a controller to permit the printer unit to print the image and restrict the printer unit from printing the image depending on normality of the obtained print logs.

9 Claims, 3 Drawing Sheets

EXAMPLE OF A PRINT LOG FILE

2008/01/06, 12:00:00, user A, AAAA1.prn, mono / 5pg., 4, Nomal completion
2008/01/01, 15:00:00, user B, BBBB1.prn, Color / 3pg., 10, Nomal completion
2008/01/01, 12:00:00, user C, CCCC1.prn, mono / 1pg., 1, Nomal completion
2008/01/01, 10:00:00, user A, AAAA2.prn, Color / 4pg., 10, Nomal completion
2007/12/21, 13:00:00, user B, BBBB2.prn, mono / 2pg., 2, Nomal completion
2007/12/11, 14:00:00, user C, CCCC3.prn, mono / 16pg., 16, Nomal completion
2007/12/01, 12:00:00, user D, DDDD1.prn, mono

FIG. 3

PRINTING DEVICE AND PRINTING SYSTEM TO MANAGE PRINT JOBS BASED ON PRINT HISTORY AND COMPUTER READABLE STORAGE MEDIUM FOR STORING A COMPUTER PROGRAM THEREFOR

CROSS REFERENCE TO RELATED APPLICATION

This application claims priority from Japanese Patent Application No. 2008-248600, filed on Sep. 26, 2008, the entire subject matter of which is incorporated herein by reference.

BACKGROUND

1. Technical Field

An aspect of the present invention relates to a printing device connectable with an external storage device, a printing system having the printing device, and a computer usable medium therefore.

2. Related Art

A printing device, which is connected to an external storage device within a printing system, has been known. When a print job is created and a printing operation according to the print job is activated in the printing device, the printing device can create a print log indicating information concerning the print job and provide the print log to the external storage device so that the external storage device stores the print log. Thus, history of the print operations having been executed in the printing device can be stored to be administrated.

SUMMARY

In such printing devices, however, the individual print logs may not be correctly registered occasionally, and the print history may not be administrated preferably depending on, for example, erroneous operations occurring in the printing devices. More specifically, when an accident, such as forcible termination of a printing operation or disconnection of communication between the printing device and the external storage device, occurs during the printing operation, the print log for the printing job may not be collected in the external storage device. If such erroneous behaviors are repeated before the print job completes, the incomplete print logs may not be registered in the history. When the incomplete print logs are left unregistered, history of the printing jobs executed in the printing device may not be administrated correctly.

In view of the above, the present invention is advantageous in that a printing device, a printing system, and a computer usable medium therefore, by which history of print jobs are correctly managed, are provided.

According to an aspect of the invention, a printing apparatus, which is connectable with an external storage device, is provided. The printing apparatus includes a printer unit configured to execute a printing operation to print an image in a current print job, a print log provider configured to provide a print log, which indicates a record of the printing operation for the current print job, to the external storage device when the printer unit activates the printing operation, a print log obtainer configured to obtain a preceding print log, indicating a record of an earlier printing operation executed earlier in the printing apparatus, provided to the external storage device by the print log provider, and stored in the external storage device, a print log examiner configured to examine the preceding print log and determine normality of the preceding print log based on the record of the earlier print operation indicated by the preceding print log, and a controller configured to permit the printer unit to print the image when the print log examiner determines that the preceding print log is normal, and restrict the printer unit from printing the image when the print log examiner determines that the preceding print log is abnormal.

With the printing apparatus according to the above configuration, the preceding print log for the earlier print job is obtained from the external storage device prior to activating the printing operation so that normality of the preceding print log can be examined. Thus, when the preceding print log is determined to be normal, the printing operation for the current print job is permitted. Meanwhile, when the preceding print log is not determined to be normal, the printing operation for the current print job is restricted from being executed. Therefore, the print logs left incomplete due to the erroneous behaviors can be prevented from leaking from history of the print logs, and the history can be correctly administrated. Accordingly, the printing operation to print the image can be controlled based on the correctly administrated print history.

According to another aspect of the invention, a printing system, having a printing apparatus and an external storage device connected to the printing apparatus, is provided. The printing apparatus includes a printer unit configured to execute a printing operation to print an image in a current print job, a print log provider configured to provide a print log, which indicates a record of the printing operation for the current print job, to the external storage device when the printer unit activates the printing operation, a print log obtainer configured to obtain a preceding print log, indicating a record of an earlier printing operation executed earlier in the printing apparatus, provided to the external storage device by the print log provider, and stored in the external storage device, a print log examiner configured to examine the preceding print log and determine normality of the preceding print log based on the record of the earlier print operation indicated by the preceding print log, and a controller configured to permit the printer unit to print the image when the print log examiner determines that the preceding print log is normal, and restrict the printer unit from printing the image when the print log examiner determines that the preceding print log is abnormal.

With the printing system according to the above configuration, the print logs left incomplete due to the erroneous behaviors can be prevented from leaking from history of the print logs, and the history can be correctly administrated. Accordingly, the printing operation to print the image can be controlled based on the correctly administrated print history.

According to still another aspect of the invention, a computer usable medium to store computer readable instructions is provided. The computer readable instructions manipulate a printing apparatus having a printer unit and being connected to an external storage device to execute steps of activating a printing operation to print an image in a current print job, providing a print log, which indicates a record of the printing operation for the current print job, to the external storage device when the printing operation is activated, obtaining a preceding print log, which indicates a record an earlier printing operation executed earlier in the printing apparatus, provided to the external storage device in the step of providing, and stored in the external storage device, examining the preceding print log to determine normality of the preceding print log based on the record of the earlier print operation indicated by the preceding print log, permitting the printer unit to print the image when the preceding print log is determined to be normal and restricting the printer unit from printing the image when the preceding print log is determined to be abnormal.

With the computer usable medium according to the above configuration, the printing apparatus can be manipulated correctly so that the print logs left incomplete due to the erroneous behaviors can be prevented from leaking from history of the print logs, and the history can be correctly administrated. Accordingly, the printing operation to print the image can be controlled based on the correctly administrated print history.

BRIEF DESCRIPTION OF THE ACCOMPANYING DRAWINGS

FIG. 3 is an illustrative view of a print log file according to the embodiment of the present invention.

DETAILED DESCRIPTION

Figure 1:
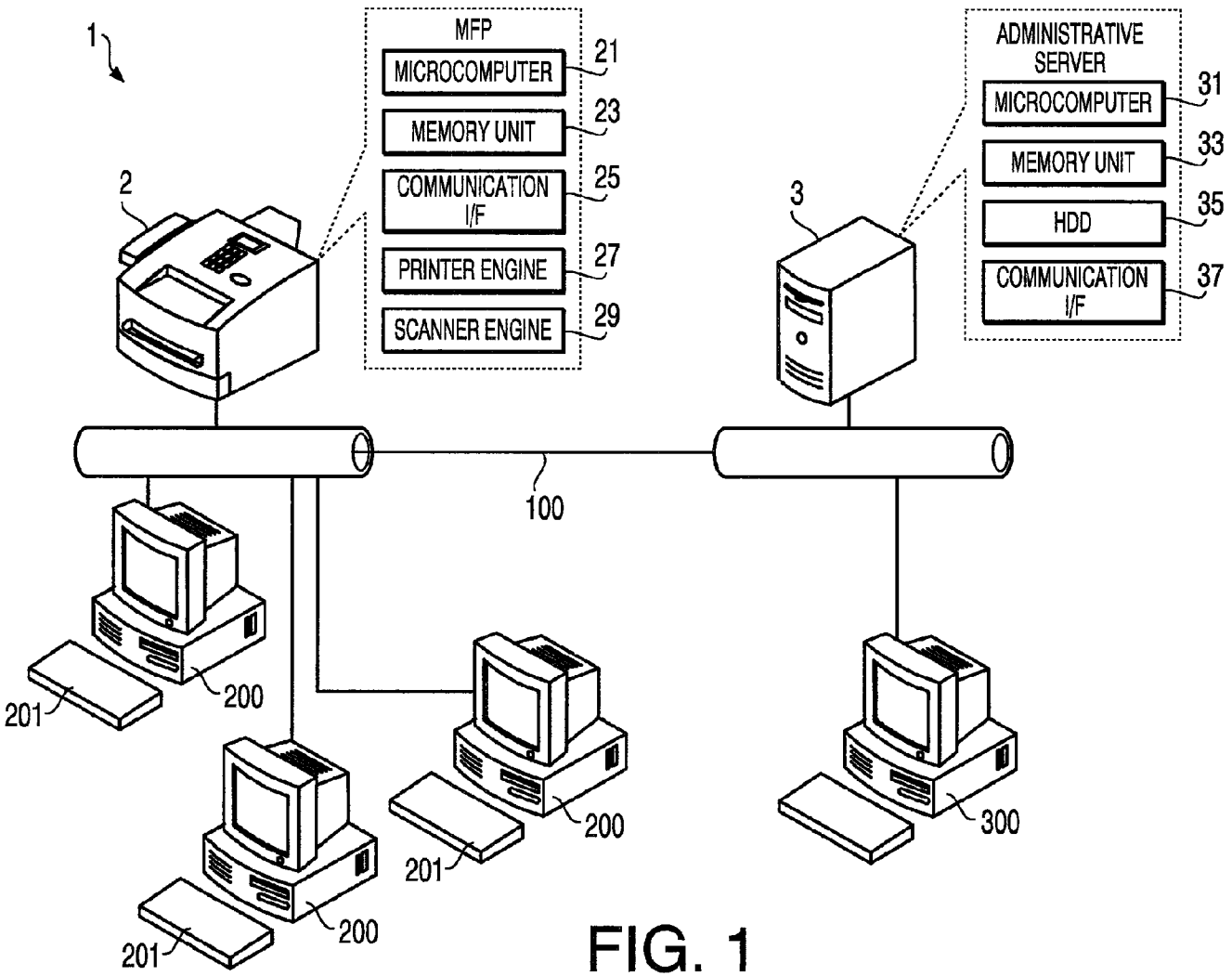
FIG. 1 is a schematic diagram to illustrate a printing system 1 according to an embodiment of the present invention.

Hereinafter, an embodiment according to an aspect of the present invention will be described with reference to the accompanying drawings.

The printing system 1 according to the present embodiment includes an MFP (multifunction peripheral) 2 and an administrative server 3, which are connected to each other through a network 100.

The MFP 2 is provided with a microcomputer 21, a storage unit 23, a communication interface (I/F) 25, a printer engine 27, and a scanner engine 29. The MFP 2 is connected with a plurality of client devices 200, which provide print jobs to the MFP 2. The MFP 2 executes print operations according to the print jobs and creates print logs which indicate the print jobs according to a program stored in the storage unit 23. The created print logs are passed to the administrative server 3 to be stored. The MFP 2 may include an input unit (not shown), through which instructions by a user can be entered.

The client devices 200 are known personal computers having input units 201, through which users' instructions are entered. Each of the client devices 200 may be shared to be used by a plurality of users.

The administrative server 3 is a known file server having a microcomputer 31, a storage unit 33, an HDD (hard disk drive) 35, and a communication interface (I/F) 37. The print logs provided by the MFP 2 are stored in the HDD 35 to be managed. The print logs stored in the HDD 35 are managed by a log management PC 300, which is connected with the administrative server 3.

Next, a printing process for a printing operation in the MFP 2 will be described with reference to FIG. 2. The printing process is activated in S110 upon receipt of a print job from one of the client devices 200. According to the present embodiment, the print job includes information to identify a user of the client device 200 which provided the print job to the MFP 2. In S110*a*, the MFP 2 refers to the identifying information in the print job.

In S120, the MFP 2 checks the identifying information to determine as to whether the user of the client device 200 provided the current print job is a predetermined "subject-to-examination" user. The subject-to-examination users are users of the client devices 200, of which past print logs are to be examined in the printing process. According to the present embodiment, specific users of the client devices 200 being capable of communicating with the MFP 2 are eliminated from the subject-to-examination users. In the present embodiment, specific users, who are assumed to be less likely to take inappropriate behaviors during printing operations, are excused from the following examination in S140. Such users are, for example, administrators of the MFP 2 of the printing system 1. Therefore, in 5120, when the print job is provided by a client device 200, of which user is not the administrator, the client device 200 is determined to be a subject-to-examination client device. According to the present embodiment, qualification of the administrator who can be excused from the examination can be recognized by the user ID.

In S120, when the MFP 2 determines that the user of the current client device 200 is a subject-to-examination user (S120: YES), the MFP 2 examines print logs including the user ID of the subject-to-examination user stored in the administrative server 3. More specifically, in S130, the MFP 2 obtains print logs including a user ID which is identical to the user ID referred to in S110*a* among print logs collected from the past print jobs and stored in the administrative server 3.

According to the present embodiment, the MFP 2 creates a print log each time a printing operation for a print job is executed. The print log includes information indicating activation and normal completion of the printing operation and the identification of the user of the client device 200 which provided the print job (i.e., the user ID). Alternatively, the user ID may be identification of the client device 200. From a leftmost column to a rightmost column, date and time in which the print job is activated, the user ID (i.e., a user name), identification of the print job (i.e., a job name), a print quality (e.g., colored or monochrome), a number of printed pages, an amount of toner used, and normal completion of the print job are indicated. When a print log is created, the items written in a left side with respect to the slashes, which are the starting date and time, the user name, the job name, and the print quality, are recorded upon activation of the printing operation. The items written in a right side with respect to the slashes, which are the number of printed pages, the amount of toner used, and normal completion without failure of the print job, are added upon completion of the printing operation.

The created print log is provided to the administrative server 3 and included in print history stored in the HDD 35 of the administrative server 3. Thus, in S130, the print logs including the user ID of the current client device 200, which is identical to the user ID referred to in S110*a*, are obtained from the HDD 35 of the administrative server 3.

When the print logs are obtained, the MFP 2 may directly access a storage area storing the print history in the HDD 35 of the administrative server 3. Alternatively, if the administrative server 3 is configured to respond to a request of the MFP 2 and transmit the print logs including the user ID to the MFP 2 in reply, the MFP 2 may transmits the request to the administrative server 3 for the print logs so that the administrative server 3 can provide the print logs to the MFP 2.

In S130, the print logs to be obtained by the MFP 2 includes at least one and a latest print log with a latest time stamp and may include all the print logs with the user ID in the past stored in the HDD 35 of the administrative server 3.

In S140, the MFP 2 examines as to whether the print logs obtained in S130 are normal print logs. In this step, more specifically, as to whether each print log indicates normal completion of the print job is examined. When one of the print logs indicates abnormal termination of the print job, i.e., when the print log does not include the indication of normal completion, the MFP 2 determines that the obtained print logs are not normal. In the present embodiment, the print logs are created in a predetermined format (e.g., a predetermined data format, language, and description format); therefore, when the print log is not written according to the predetermined format, the print log is also determined to be abnormal.

In S140, if the MFP 2 determines that the print logs are normal (S140: YES), in S150, the MFP 2 provides a print log indicating activation of a printing operation for the print job which was received in S110 to the administrative server 3. In S150, specifically, the print Job includes information concerning the date and the time in which the printing operation is activated, the user ID of the current client device 200, and the print job name. The print job is provided to the MFP 2 and stored in the HDD 35. In the present embodiment, a print log including items in the left side of the print log indicated in a topmost line shown in FIG. 3, which are 2008 Jan. 6, 12:00:00, User A, AAAA1.prn, mono, is created by the MFP 2 and stored in the HDD 35 of the administrative server 3.

In S160, the MFP 2 examines as to whether the print log provided to the administrative server 3 in S150 was saved in the HDD 35 without failure. In this step, if the administrative server 3 is configured to respond to a request of the MFP 2 and stores the print log in the HDD 35 in response to the request, the MFP 2 may determine that the print log was registered without failure when information to notify the MFP 2 of the safe registration is provided to the MFP 2. Alternatively, for example, the MFP 2 may determine the safe registration of the print log when no error indication is provided to the MFP 2. When the print log was registered without failure in the HDD 35 of the administrative server 3 (S160: YES), in S170, the MFP 2 manipulates the printer engine 27 to print an image as described in the print job, which was received in S110.

When the printing operation executed in S170 completes, in S180, the print log registered in the HDD 35 in the administrative server 3 in S150 is updated. In particular, additional information for the print log, indicating a number of printed pages, an amount of toner used, and normal completion of the printing operation without failure, is provided to the administrative server 3 and added to the print log registered in S150. In the present embodiment, items in the right side of the print log indicated in the topmost line shown in FIG. 3, which are 5 pages, 4, normal completion; are added to the print log in the topmost line and stored in the HDD 35 of the administrative server 3. Thus, the print log is updated, and the MFP 2 completes the printing process.

In S160, when the MFP 2 does not recognize normal registration of the print log provided to the administrative server 3 in S150 (S160: NO), the MFP 2 terminates the printing process without executing S170 or S180.

In S140, when the MFP 2 does not recognize the print logs are normal (S140: NO), the MFP 2 omits S150-S180 and terminates the printing process.

In S120, when the MFP 2 does not recognize the user of the current client device 200 is not a subject-to-examination user, i.e., the current client device 200 is a client device 200 being used by an administrator (S120: NO), the MFP 2 proceeds to S150 without obtaining or examining the past print logs with the user ID. Thus, the print log for the current print job is provided to the administrative server 3, and the printing operation for the current print job is activated in S150. The MFP 2 completes the printing process after executing S160-S180.

According to the MFP 2 configured to behave as above, the past print logs collected in the administrative server 3 are obtained (S130 in FIG. 2) prior to activation of the printing operation. When the obtained print logs are normal print logs, which indicate the print jobs provided by the same user in the past were normally completed (S140: YES), a printing operation for the current print job is allowed to be activated (S170). Meanwhile, when the obtained print logs are not normal print logs (S140: NO), the printing operation for the current print job is restricted from being carried out.

Therefore, when a user is aware that an inappropriate behavior may result in forcible prevention of the printing operation, the printing job can be eventually prevented from leaking from the history of the print jobs, and the history of the print jobs are correctly managed. The inappropriate behavior includes, for example, forcible termination of a printing operation before the MFP 2 completes the print job. For another example, the inappropriate behavior includes unplugging a communication cable which connects the administrative server 3 and the MFP 2 so that the communication therebetween is forcibly disconnected.

When the history of print jobs are correctly managed according to the above configuration, a printing service, which can be charged based on a number of pages printed, and/or an amount of toner used recorded in the print logs, can be suggested. In order for such a service to be charged, a complete print log for the print job needs to be recorded; therefore, if the inappropriate behavior is taken before completion of the printing operation, the print log is left incomplete in the HDD 35 of the administrative server 3. In such a case, the print log indicates that the print job remains incomplete, and an amount to be charged cannot be determined; i.e., the service cannot be charged properly. However, although the administrative server 3 does not store complete print log for the print job, a new print job provided by the same user which ordered the previous incomplete print job is prevented from being carried out.

Thus, a printing operation for a print job ordered by a malicious user, who attempts to repeat the inappropriate behavior, can be eliminated from being carried out, and the service can be properly provided to be charged.

Further, according to the above configuration, when the inappropriate behavior is taken before completion of the printing operation, the incomplete print log is stored in association with the user ID of the current client device 200 (i.e., omitting S180). The incomplete print log may appear, for example, a lowermost line shown in FIG. 3.

When the MFP 2 receives a new order for a printing operation from the same user, the print log stored in the administrative server 3 in association with the same user ID indicates abnormal; therefore, the new and succeeding printing operations can be restricted from being carried out (S140: NO). According to the above configuration, printing operations for the client devices 200 other than the client device 200 of the inappropriately behaving user are allowed.

Further, according to the above configuration, a predetermined number of print logs, which at least includes a latest print log (S130). Therefore, when the MFP 2 receives the print job provided by the client device 200 of the user who behaved inappropriately in the past, the abnormality of the print job, i.e., hazardousness of the user can be speedily detected.

According to the above embodiment, the abnormality of the print job can be determined based on incompleteness of the print log which is obtained from the administrative server 3 (S140).

According to the above embodiment, the abnormality of the print job can be determined based on the format of the print log which is obtained from the administrative server 3 (S140).

Furthermore, print logs with the user ID which is identical to the user ID of the subject-to-examination user among print logs of the plurality of users are examined (S120: YES) in order to have the printing operations executed (S130-S170). In other words, the users who are determined not to be the subject-to-examination users are allowed to have the printing operations executed (S120: NO, S150-S170). Therefore, for example, the administrator of the printing system 1, who is less likely to take the inappropriate behaviors, is eliminated from the examination so that the print job provided by the administrator can be executed without the restriction.

Although an example of carrying out the invention has been described, those skilled in the art will appreciate that there are numerous variations and permutations of the printing apparatus, the printing system, and the computer usable medium that fall within the spirit and scope of the invention as set forth in the appended claims. It is to be understood that the subject matter defined in the appended claims is not necessarily limited to the specific features or act described above. Rather, the specific features and acts described above are disclosed as example forms of implementing the claims.

For example, in the above embodiment, the MFP 2 is configured to execute the printing operation according to the print job provided from one of the client devices 200. However, the print job may be created in the MFP 2 provided to the MFP 2 itself. In other words, the user may manipulate the MFP 2 to generate the print job including the user ID and order the MFP 2 to execute a printing operation based on the print job. In particular, the user may use the MFP 2 to have a duplicate of an original document. In such a case, the MFP 2 manipulates the scanner engine 29 to scan an image on the original document and activate a print job to have the scanned image printed. In this regard, the MFP 2 may be configured to require the user to enter the user ID when the MFP 2 scans the original image so that the user ID is examined in S120 to determine as to whether the user is a subject-to-examination user.

Figure 2:
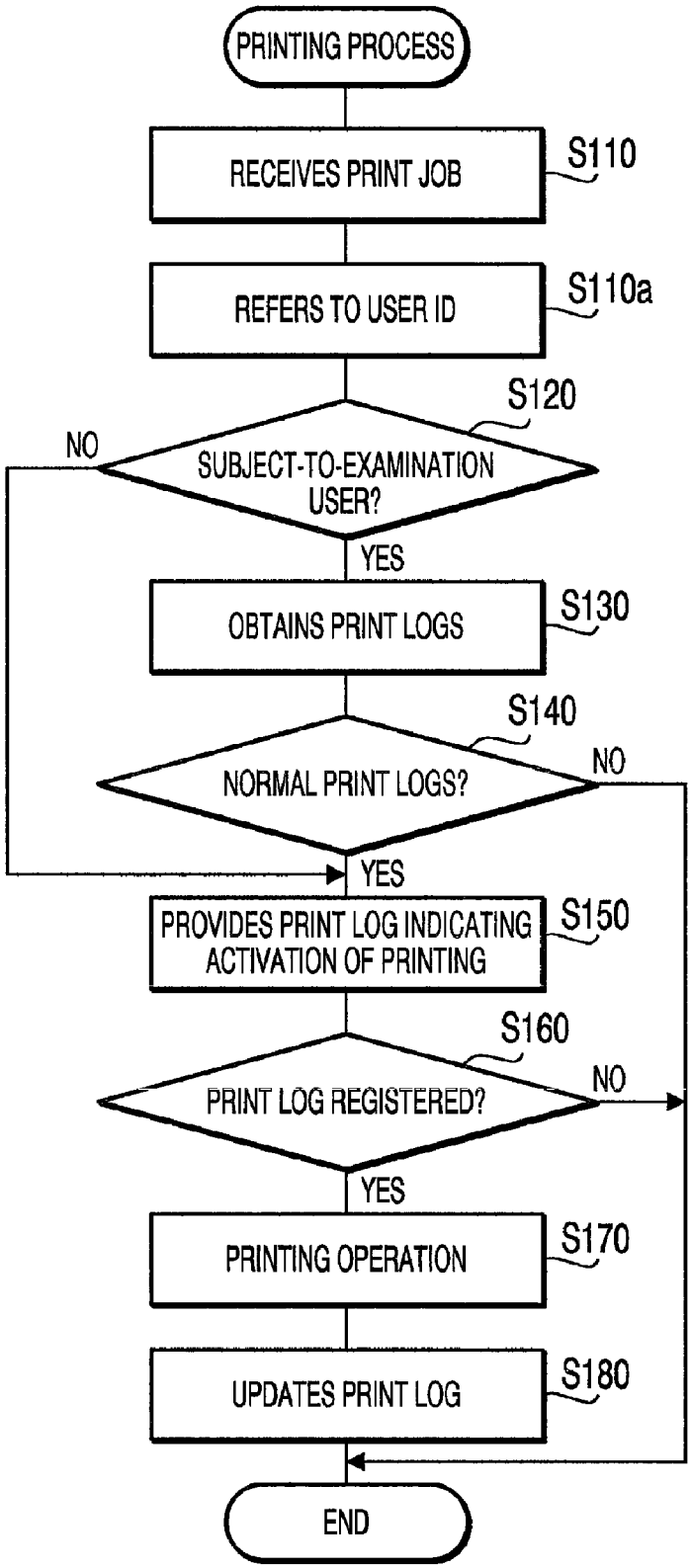
FIG. 2 is a flowchart to illustrate a printing operation according to the embodiment of the present invention.

According to the above configuration, the MFP 2 can activate the printing process as shown in FIG. 2 after the scanning operation so that the print job created based on the scanned image is received in S110 and the print logs stored in association with the identification of the user are obtained in S130. Thus, a new print log indicating the user ID can be created in S150 and provided to the administrative server 3.

For another example, application of the present invention is not limited to the MFP 2 having the plurality of functions, i.e., the printing function and the scanning function, but the present invention can be applied to any device which has at least a printing function.

What is claimed is:

1. A printing apparatus, which is connectable with an external storage device, comprising:

a printer unit configured to execute a printing operation to print an image according to a current print job;

a print log provider configured to provide a print log, which indicates a record of the printing operation for the current print job, to the external storage device to be stored when the printer unit activates the printing operation;

a print log obtainer configured to obtain a preceding print log, indicating a record of an earlier printing operation executed earlier in the printing apparatus, wherein the preceding print log has been provided to the external storage device by the print log provider, and stored in the external storage device;

a print log examiner configured to examine the preceding print log and determine normality of the preceding print log based on the record of the earlier print operation indicated by the preceding print log; and a controller configured to permit the printer unit to print the image when the print log examiner determines that the preceding print log is normal, and restrict the printer unit from printing the image when the print log examiner determines that the preceding print log is abnormal, wherein the print log obtainer obtains the preceding print log including the identifier of the client among a plurality of print logs provided to the external storage device earlier and stored in the external storage device.

2. The printing apparatus according to claim 1, wherein the print log provider provides the print log including the record of the printing operation and an identifier of a client that instructs the printing apparatus to print the image according to the current print job, to the external storage device.

3. The printing apparatus according to claim 2, wherein the print log obtainer obtains a predetermined number of preceding print logs including a latest print log, the latest print log having been provided to the external storage device by the print log provider in the latest print job prior to the current print job.

4. The printing apparatus according to claim 1, wherein the print log provider provides the print log to the external storage device to be stored therein after the printer unit activates the printing operation and, when the printing operation completes normally, updates the print log stored in the external storage device so that the updated print log indicates normal completion of the printing operation; and wherein, when the print log examiner examines the preceding print log and determines that the preceding print log does not indicate normal completion of a preceding printing operation, the print log examiner determines that the preceding print log is abnormal.

5. The printing apparatus according to claim 1, wherein the print log examiner examines the preceding print log and determines that the preceding print log is abnormal when the preceding print log is not written in a predetermined format.

6. The printing apparatus according to claim 1, further comprising:

a subject determiner configured to determine as to whether the client that instructs the printing apparatus to print the image according to the current print job is a subject-to-examination client;

wherein, when the subject determiner determines that the client is a subject-to-examination client, the printer unit executes the printing operation after the print log obtainer obtains the preceding print log, and the print log examiner determines normality of the obtained preceding print log; and wherein, when the subject determiner determines that the client is not a subject-to-examination client, the printer unit executes the printing operation, and activation of the print log obtainer and the print log examiner is omitted.

7. The printing apparatus according to claim 2, further comprising:

a scanner unit configured to scan an original image and generate a print job to print the scanned image; and an input unit to input the identifier of the client who instructs the printing apparatus to print the scanned image according to the print job.

8. A printing system, comprising a printing apparatus and an external storage device connected to the printing apparatus;

wherein the printing apparatus includes:

a printer unit configured to execute a printing operation to print an image in a current print job;

a print log provider configured to provide a print log, which indicates a record of the printing operation for the current print job, to the external storage device when the printer unit activates the printing operation;

a print log obtainer configured to obtain a preceding print log, indicating a record of an earlier printing operation executed earlier in the printing apparatus, wherein the preceding print log has been provided to the external storage device by the print log provider, and stored in the external storage device;

a print log examiner configured to examine the preceding print log and determine normality of the preceding print log based on the record of the earlier print operation indicated by the preceding print log; and a controller configured to permit the printer unit to print the image when the print log examiner determines that the preceding print log is normal, and restrict the printer unit from printing the image when the print log examiner determines that the preceding print log is abnormal, wherein the print log obtainer obtains the preceding print log including the identifier of the client among a plurality of print logs provided to the external storage device earlier and stored in the external storage device.

9. A non-transitory computer usable medium to store computer readable instructions, which manipulate a printing apparatus having a printer unit and being connected to an external storage device to execute steps of:

activating a printing operation to print an image in a current print job;

providing a print log, which indicates a record of the printing operation for the current print job, to the external storage device when the printing operation is activated;

obtaining a preceding print log, which indicates a record of an earlier printing operation executed earlier in the printing apparatus, wherein the preceding print log has been provided to the external storage device in the step of providing, and stored in the external storage device;

examining the preceding print log to determine normality of the preceding print log based on the record of the earlier print operation indicated by the preceding print log;

permitting the printer unit to print the image when the preceding print log is determined to be normal and restricting the printer unit from printing the image when the preceding print log is determined to be abnormal, wherein, in the step of obtaining, the preceding print log including the identifier of the client among a plurality of print logs provided to the external storage device earlier and stored in the external storage device is obtained.

* * * * *